US011585189B2

(12) United States Patent
Rajagopalan et al.

(10) Patent No.: US 11,585,189 B2
(45) Date of Patent: Feb. 21, 2023

(54) SYSTEMS AND METHODS FOR RECYCLING EXCESS ENERGY

(71) Applicant: Halliburton Energy Services, Inc., Houston, TX (US)

(72) Inventors: Satish Rajagopalan, Tomball, TX (US); Heiko Schmirgel, Dickinson, TX (US); Richard Hay, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 35 days.

(21) Appl. No.: 16/706,175

(22) PCT Filed: Dec. 26, 2018

(86) PCT No.: PCT/US2018/067475
§ 371 (c)(1),
(2) Date: Dec. 6, 2019

(87) PCT Pub. No.: WO2020/139317
PCT Pub. Date: Jul. 2, 2020

(65) Prior Publication Data

US 2021/0277748 A1 Sep. 9, 2021

(51) Int. Cl.
*E21B 41/00* (2006.01)
*E21B 4/02* (2006.01)
(Continued)

(52) U.S. Cl.
CPC ..... *E21B 41/0085* (2013.01); *E21B 4/02* (2013.01); *E21B 7/06* (2013.01); *E21B 47/12* (2013.01)

(58) Field of Classification Search
CPC ..... E21B 41/0085; E21B 4/02; E21B 7/06; E21B 47/12
See application file for complete search history.

(56) References Cited

U.S. PATENT DOCUMENTS 5,149,984 A * 9/1992 Schultz ..... E21B 34/06 290/54
5,517,464 A 5/1996 Lerner et al.
(Continued)

FOREIGN PATENT DOCUMENTS

GB 2543400 A 4/2017
WO 2014178886 A1 11/2014

OTHER PUBLICATIONS

International Search Report and Written Opinion dated Sep. 20, 2019 for PCT Application No. PCT/US2018/067475 filed Dec. 26, 2018 (10 pages).

*Primary Examiner* — Dany E Akakpo
(74) *Attorney, Agent, or Firm* — K&L Gates LLP

(57) ABSTRACT

A system for and method of use with a downhole tool that includes a tubular with a fluid flow path therethrough for flowing a fluid and a housing coupleable to a downhole portion of the tubular. A fluid-driven motor assembly is included and has a drive shaft rotatable to output rotational drive forces. An electric generator is coupled to the drive shaft to convert the rotational drive forces into electrical power. There is also an electric motor electrically coupled to the electric generator to convert electrical output of the electric generator into a rotational drive force to control the downhole tool. A controller is electrically coupled to the electric motor and the electric generator to conduct electrical power output from the electric motor to the electric generator and dissipate excess energy produced by the electric motor to the fluid-driven motor assembly as hydraulic energy.

13 Claims, 8 Drawing Sheets

(51) Int. Cl.
*E21B 7/06* (2006.01)
*E21B 47/12* (2012.01)

(56) References Cited

U.S. PATENT DOCUMENTS

| | | | | |
|---|---|---|---|---|
| 6,092,610 | A * | 7/2000 | Kosmala | E21B 4/20 175/61 |
| 7,527,101 | B2 | 5/2009 | Mayes | |
| 2004/0262043 | A1 | 12/2004 | Schuaf | |
| 2010/0073189 | A1 * | 3/2010 | Mandal | E21B 47/12 318/400.34 |
| 2010/0078161 | A1 | 4/2010 | Krueger et al. | |
| 2013/0222149 | A1 | 8/2013 | Li et al. | |
| 2015/0260014 | A1 | 9/2015 | Zimmerman | |
| 2018/0163514 | A1 | 6/2018 | Guven et al. | |
| 2018/0287533 | A1 | 10/2018 | Rajagopalan | |

* cited by examiner

SYSTEMS AND METHODS FOR RECYCLING EXCESS ENERGY

BACKGROUND

Boreholes, which are also referred to as "wellbores" and "drill holes," are created for a variety of purposes, including exploratory drilling for locating underground deposits of different natural resources, mining operations for extracting such deposits, and construction projects for installing underground utilities. A misconception is that all boreholes are vertically aligned with the drilling rig; however, many applications require the drilling of boreholes with vertically deviated and horizontal geometries. A technique employed for drilling horizontal, vertically deviated, and other complex boreholes is directional drilling. Directional drilling is a process of drilling a borehole where at least a portion of the course of the borehole in the earth is in a direction other than strictly vertical—i.e., the axes make an angle with a vertical plane (known as "vertical deviation") and are directed in an azimuth plane.

Directional drilling techniques operate from a drilling device that pushes or steers a series of connected drill pipes with a drill bit at the far end thereof to achieve the desired borehole path. In the exploration and recovery of subsurface hydrocarbon deposits, such as petroleum and natural gas, the directional borehole is typically drilled with a rotatable drill bit that is attached to one end of a bottomhole assembly or "BHA." A steerable BHA can include, for example, a positive displacement motor (PDM) or "mud motor," drill collars, reamers, shocks, and underreaming tools to enlarge the wellbore. A stabilizer may be attached to the BHA to control the bending of the BHA to direct the bit in the desired direction (inclination and azimuth). The BHA, in turn, is attached to the bottom of a tubing assembly, often comprising jointed pipe or relatively flexible "spoolable" tubing, also known as "coiled tubing." This directional drilling system—i.e., the operatively interconnected tubing, drill bit, and BHA—can be referred to as a "drill string." When jointed pipe is utilized in the drill string, the drill bit can be rotated by rotating the jointed pipe from the surface, through the operation of the mud motor contained in the BHA, or both. In contrast, drill strings which employ coiled tubing generally rotate the drill bit via the mud motor in the BHA.

Advances in drilling techniques and technology have produced various types of downhole tools that provide an assortment of enhanced drilling features, such as hole enlargement, steering feedback, torque reduction, BHA monitoring, borehole evaluation, and drag resistance improvement. A few examples of some such downhole tools can include rotary steerable tools, stabilizers, sensor assemblies, agitator tools, reamers, measurement-while-drilling (MWD) tools, etc. On the larger end of the spectrum, some electric motors are used for rotating the drill bit and some for operating downhole pumps to provide forward and reverse circulation of the drilling fluid.

With the installation of downhole tools comes a need for dependable and efficient power sources to drive and regulate electrical components. A variety of mud-driven electrical power generators have been devised for supplying electricity to downhole tools. In some situations, the electrical components of the downhole tools may also produce unwanted electrical energy, such as when an electric motor decelerates, that may need to be dissipated to prevent any damage to electrical components downhole by exceeding the power thresholds of the components. As an example, the excess energy may be dissipated as heat in a network of resistors.

However, the resistor network also suffers from having a power threshold and may fail if overloaded by a power surge from the downhole tool.

BRIEF DESCRIPTION OF THE DRAWINGS

Embodiments of the invention are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

Figure 1:
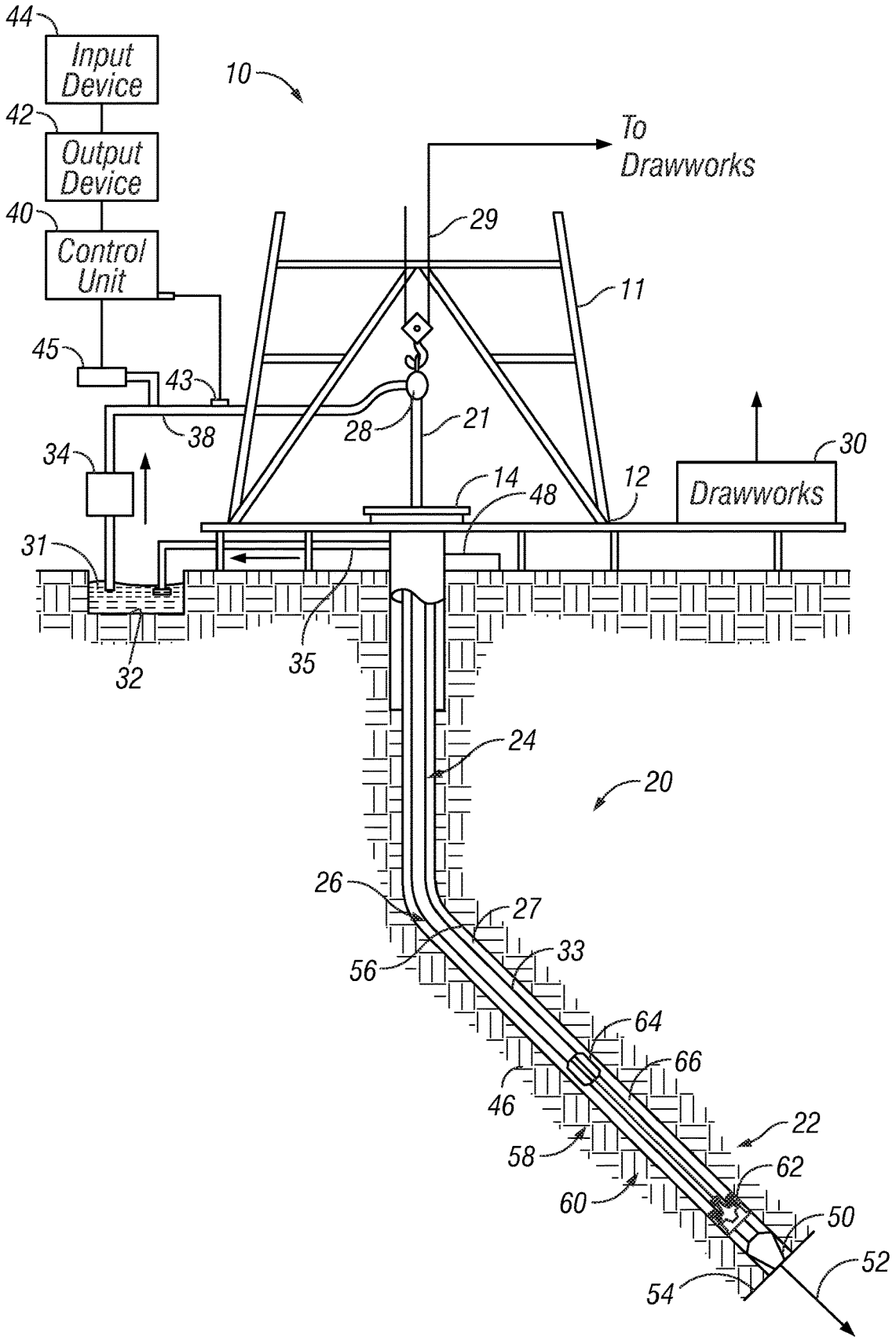
FIG. 1 depicts an elevation view of a direction drilling system, according to one or more embodiments.

The present disclosure describes a method, system, and tool to dissipate excess electrical energy as hydraulic energy in a wellbore. FIG. 1 depicts an elevation view of an exemplary directional drilling system 10, in accordance with aspects of the present disclosure. Many of the disclosed concepts are discussed with reference to drilling operations for the exploration and/or recovery of subsurface hydrocarbon deposits, such as petroleum and natural gas. However, the disclosed concepts are not so limited, and can be applied to other drilling operations. The directional drilling system 10 exemplified in FIG. 1 includes a tower or "derrick" 11, as it is most commonly referred to in the art, that is buttressed by a derrick floor 12. The derrick floor 12 supports a rotary table 14 that is driven at a desired rotational speed, for example, via a chain drive system through operation of a prime mover (not shown). The rotary table 14, in turn, provides the necessary rotational force to a drill string 20. The drill string 20, which includes a drill pipe section 24, extends downwardly from the rotary table 14 into a directional borehole 26. As illustrated in the Figures, the borehole 26 may travel along a multi-dimensional path or "trajectory." The three-dimensional direction of the bottom 54 of the borehole 26 of FIG. 1 is represented by a pointing vector 52.

A drill bit 50 is attached to the distal, downhole end of the drill string 20. When rotated, e.g., via the rotary table 14, the drill bit 50 operates to break up and generally disintegrate the geological formation 46. The drill string 20 is coupled to a "drawworks" hoisting apparatus 30, for example, via a kelly joint 21, swivel 28, and line 29 through a pulley system (not shown). The drawworks 30 may comprise various components, including a drum, one or more motors, a reduction gear, a main brake, and an auxiliary brake. During a drilling operation, the drawworks 30 can be operated, in some embodiments, to control the weight on bit 50 and the rate of penetration of the drill string 20 into the borehole 26. The operation of drawworks 30 is generally known and is thus not described in detail herein.

During drilling operations, a suitable drilling fluid (commonly referred to in the art as "mud") 31 can be circulated, under pressure, out from a mud pit 32 and into the borehole 26 down through the drill string 20 by a hydraulic "mud pump" 34. The drilling fluid 31 may comprise, for example, water-based muds (WBM), which typically comprise a water-and-clay based composition, oil-based muds (OBM), where the base fluid is a petroleum product, such as diesel fuel, synthetic-based muds (SBM), where the base fluid is a synthetic oil, as well as gaseous drilling fluids. Drilling fluid 31 passes from the mud pump 34 into the drill string 20 via a fluid conduit (commonly referred to as a "mud line") 38 and the kelly joint 21. Drilling fluid 31 is discharged at the borehole bottom 54 through an opening or nozzle in the drill bit 50, and circulates in an "uphole" direction towards the surface through an annular space 27 between the drill string 20 and the side 56 of the borehole 26. As the drilling fluid 31 approaches the rotary table 14, it is discharged via a return line 35 into the mud pit 32. A variety of surface sensors 48, which are appropriately deployed at or near the surface of the borehole 26, operate alone or in conjunction with downhole sensors 70, 72 deployed within the borehole 26, to provide information about various drilling-related parameters, such as fluid flow rate, weight on bit, hook load, etc., which will be explained in further detail below.

A surface control unit 40 may receive signals from surface and downhole sensors and devices via a sensor or transducer 43, which can be placed on the fluid line 38. The surface control unit 40 can be operable to process such signals according to programmed instructions provided to surface control unit 40. Surface control unit 40 may present to an operator desired drilling parameters and other information via one or more output devices 42, such as a display, a computer monitor, speakers, lights, etc., which may be used by the operator to control the drilling operations. Surface control unit 40 may contain a computer, memory for storing data, a data recorder, and other known and hereinafter developed peripherals. Surface control unit 40 may also include models and may process data according to programmed instructions, and respond to user commands entered through a suitable input device 44, which may be in the nature of a keyboard, touchscreen, microphone, mouse, joystick, etc.

In some embodiments of the present disclosure, the rotatable drill bit 50 is attached at a distal, or far, end of a steerable drilling bottom hole assembly (BHA) 22. In the illustrated embodiment, the BHA 22 is coupled between the drill bit 50 and the drill pipe section 24 of the drill string 20. The BHA 22 may comprise a Measurement While Drilling (MWD) System, designated generally at 58 in FIG. 1, with various sensors to provide information about the formation and downhole drilling parameters. The MWD sensors in the BHA 22 may include, but are not limited to, a device for measuring the formation resistivity near the drill bit, a gamma ray device for measuring the formation gamma ray intensity, devices for determining the inclination and azimuth of the drill string, and pressure sensors for measuring drilling fluid pressure downhole. The MWD may also include additional/alternative sensing devices for measuring shock, vibration, torque, telemetry, etc. The above-noted devices may transmit data to a downhole transmitter 33, which in turn transmits the data uphole to the surface control unit 40. In some embodiments, the BHA 22 may also include a Logging While Drilling (LWD) System.

In some embodiments, a mud pulse telemetry technique may be used to communicate data from downhole sensors and devices during drilling operations. Other methods of telemetry which may be used without departing from the intended scope of this disclosure include electromagnetic telemetry, acoustic telemetry, and wired drill pipe telemetry, among others.

A transducer 43 can be placed in the mud supply line 38 to detect the mud pulses responsive to the data transmitted by the downhole transmitter 33. The transducer 43 in turn generates electrical signals, for example, in response to the mud pressure variations and transmits such signals to the surface control unit 40. Alternatively, other telemetry techniques such as electromagnetic and/or acoustic techniques or any other suitable techniques known or hereinafter developed may be utilized. By way of example, hard wired drill pipe may be used to communicate between the surface and downhole devices. In another example, combinations of the techniques described may be used. As illustrated in FIG. 1, a surface transmitter receiver 45 communicates with downhole tools using, for example, any of the transmission techniques described, such as a mud pulse telemetry technique. This can enable two-way communication between the surface control unit 40 and the downhole tools described below.

According to aspects of this disclosure, the BHA 22 can provide some or all of the requisite force for the bit 50 to break through the formation 46 (known as "weight on bit") and provide the necessary directional control for drilling the borehole 26. In the embodiments illustrated in FIGS. 1 and 2, the BHA 22 may comprise a rotary steerable system 60 including a drilling motor 66 and first and second longitudinally spaced stabilizers 62 and 64. At least one of the stabilizers 62, 64 may be an adjustable stabilizer that is operable to assist in controlling the direction of the borehole 26. Optional radially adjustable stabilizers, such as push pads, may be used in the BHA 22 of the steerable directional drilling system 10 to adjust the angle of the BHA 22 with respect to the axis of the borehole 26. It should be appreciated that the drilling system 10 may also employ coiled tubing instead of the drill string 20 to convey the BHA 22.

Figure 2:
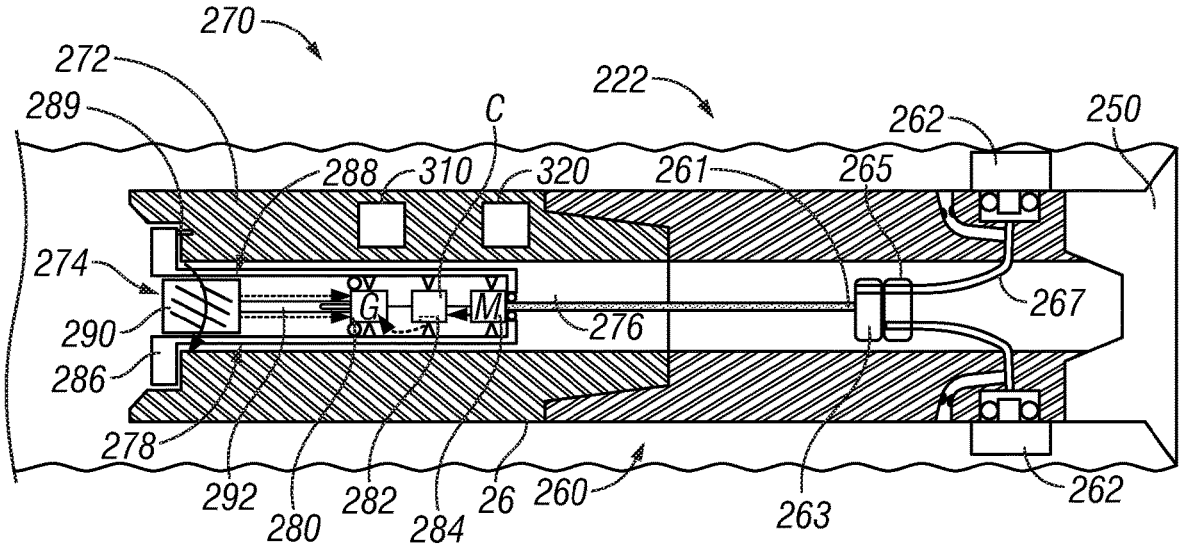
FIG. 2 depicts a schematic view of a power generation unit for powering one or more downhole tools, according to one or more embodiments.

FIG. 2 shows a schematic view of a representative power generation unit 270, for powering one or more downhole tools locatable along a drill string (e.g., the drill string 20 shown in FIG. 1). The power generation unit 270 is also operable to dissipate excess electrical energy produced by the downhole tools as hydraulic energy as further described herein. A tubular, comprising a fluid flow path therethrough for flowing a fluid, to which the power generation unit 270 is operatively coupled can take on various forms, optional configurations, and functional alternatives, some of which are described above with respect to the directional drilling system 10 exemplified in FIG. 1. By way of non-limiting example, the drill string system can include a drill-pipe string, such as drill pipe section 24, or coiled tubing through which drilling fluid (e.g., mud 31) is circulated downhole, under pressure, into a borehole by mud pump 34 of FIG. 1. A rotatable drill bit 250 is operatively coupled to the power generation unit 270 at a distal end of the drill-pipe string (e.g., projecting from BHA 222). One or more downhole tools, such as a rotary steerable system 260 including push pads 262, are included with the BHA and powered by the power generation unit 270. Only selected components of the drill string system have been shown and will be described in additional detail below.

Referring to FIG. 2, the power generation unit 270 includes a housing 272 that is coupleable to a downhole portion of the drill string and includes a fluid inlet 274 to receive at least a portion, and in some embodiments only a regulated or "diverted" portion, of the drilling fluid flowing downhole through the drill string. In at least some configurations, the power generation unit 270 is "modular"—e.g., a substantially or completely self-contained unit that can be readily interchanged with other like-configured units. As shown, the only external features that may be required for full functionality of the downhole power generation unit 270 is power conditioning of generator output and output connectivity for transmitting power to the downhole tools. Moreover, the power generation unit 270 can be mounted on an interior or, in some preferred embodiments, an exterior surface of a drilling tool, such as a collar. Mounting the power generation unit 270 to an exterior surface of a downhole portion of the drill string 20 allows for easier access to the unit 270, for example, for installation, maintenance, replacement and configuration, which in turn reduces downtime, overhead, and labor time and costs. Optionally, the power generation unit 270 can be located on an exterior surface of a non-rotating housing of a rotary steerable tool, which eliminates the need for slip-ring devices for transmitting power from the unit 270 to the downhole tools.

The power generation unit 270 is operable to power one or more downhole tools 310. These downhole tools may include, in various combinations, one or more hydraulically powered/actuated downhole tools, one or more electrically powered/actuated downhole tools, and one or more mechanically powered/actuated downhole tools. The downhole power generation unit 270 could be used to power, for example, resistivity measurement tools, density measurement tools, porosity measurement tools, acoustic measurement tools, natural gamma tools, position measurement tools, etc. The power generation unit 270 could also be used to power many types of telemetry systems 320, such as a mud pulse telemetry, acoustic telemetry, or electro-magnetic telemetry, as well as to power steering devices used to control the direction of the well.

As noted above, the housing 272 has a fluid inlet 274 at a first longitudinal end of the housing 272 and a fluid outlet 276 at a second longitudinal end opposite the first longitudinal end. Located inside the housing 272 are a fluid-driven motor assembly 278; an electric generator 280 downstream from the motor assembly 278; an electric controller 282 operable to regulate the electrical output of the power generation unit 270; and an electric motor 284 in electrical communication with the electric generator 280 and configured to convert electrical output of the electric generator 280 into a rotational drive force to control a downhole tool, such as the rotary steerable system 260, represented by a load 296.

The fluid-driven motor assembly 278 is a turbine motor 288 with a multi-bladed (or, alternatively, multi-lobed) stator with a rotatable blade-bearing rotor disposed inside the stator. The turbine 288 is coupled to a carrier 286, which is coupled with the housing 272 and uses an alignment pin 289 to prevent relative rotation between the carrier 286 and the housing 272 and thus the turbine 288 and the housing 272. The carrier 286 also optionally houses the electric generator/motor 280, the electric controller 282, and the electric motor/generator 284 as shown in FIG. 2. Pressurized drilling fluid that is bypassed into the power generation unit 270 through the fluid inlet port 274 and passed into the internal passage between the turbine 288 stator and the rotor imparts a force on angled rotor blades 290 of the turbine 288 causing the rotor to rotate within the stator. A drive shaft 292 coupled to the rotor is configured to output the rotational drive forces generated by the fluid-driven motor assembly 278.

Some advantages of using a turbine motor include the overall simplicity of its design and the ability to package a turbine motor in a wider variety of locations. In addition, the turbine motor can operate at higher temperatures and output at higher speeds than many of its conventional counterparts. The high-speed output of a turbine motor allows for an overall reduction in the size of the generator. In alternative embodiments, the power generation unit 270 may further include, or the fluid-driven motor assembly 278 may be replaced by, other fluid-driven motor arrangements, such as a positive displacement motor (PDM), without departing from the intended scope and spirit of the present disclosure. Several non-limiting examples of hydraulic motors that may be used include progressive cavity motors, twin screw motors, helical gear motors, gerotor motors, axial piston motors, and vane motors. Another type of kinetic motor that could be used, in addition to the motor assembly 278 described above, is an impeller-based motor design where the fluid changes directions off the turbine/stator vane.

Rotational drive forces generated by the motor assembly 278 are transmitted via the drive shaft 292 to the electric generator 280, which is configured to convert this rotational power into electrical power to drive various electrically powered downhole tools. The electric generator 280 may be a single-phase or multi-phase (e.g., 3-phase) permanent magnet alternator or an induction machine that is coupled to the drive shaft 292. The motor assembly 278 transmits rotational drive forces through the drive shaft 292 to the electric generator 280, which causes a magnetically charged rotor to spin within stator windings of the alternator. By rotating the rotor, the magnets on the rotor create an alternating magnetic field that induces an alternating voltage across the internal cluster of stator windings, thereby converting the mechanical power of the motor assembly 278 into electrical energy in the form of alternating current and voltage. It should be appreciated that the electric motor 284 may be operatively coupled to control other suitable downhole tools besides a rotary steerable system. As a non-limiting example, the electric motor 284 is operatively coupled to a drive shaft 261 to transmit the rotational forces output by the electric motor 284 to a rotary valve 263. As the electric motor 284 outputs rotational drive forces, the rotary valve 263 rotates to allow drilling fluid to selectively flow into a multi-ported fluid channel 265 in fluid communication with the push pads 262 via fluid conduits 267. The multi-ported fluid channel 265 includes ports circumferentially spaced apart and coupled to respective conduits 267 to deliver drilling fluid to one of the push pads 262. The drilling fluid is received in the appropriate port of the fluid channel 265 to actuate one of the push pads 262 radially outward from the BHA to push against the borehole wall over a desired rotational arc length and steer the drill bit 250 in the opposite direction of the push. As the fluid channel 265 rotates with the BHA 222, the electric motor 284 controls the rotational speed of the rotary valve 263 to stay aligned with the respective port of the fluid channel 265 necessary to actuate one of the push pads 262 and steer the drill bit 250. The MWD 58 of FIG. 1 may include sensors configured to provide the suitable rotational speed of the BHA 222 and orientation of the wellbore trajectory to trigger the appropriate push pad 262 at the appropriate time during the rotation of the BHA.

Figure 3A:
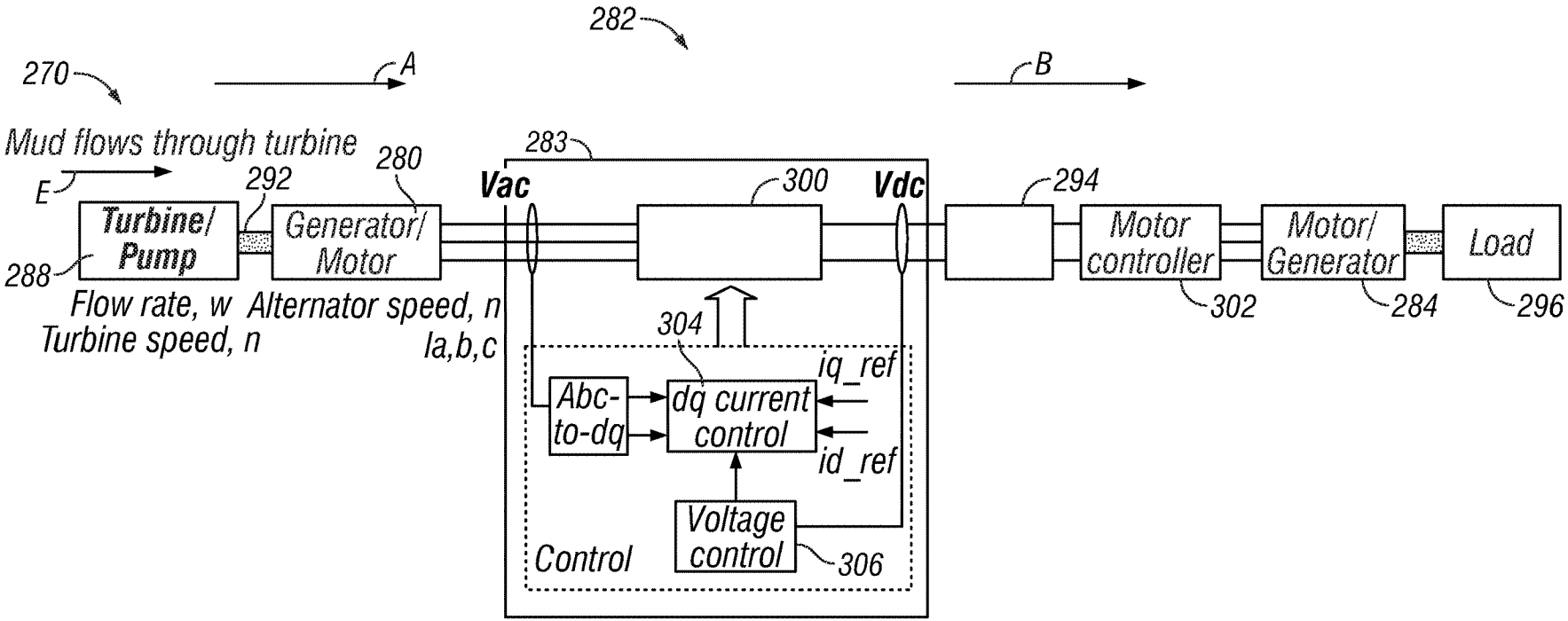
FIG. 3A shows a block diagram view of the power generation unit operating to supply power for one more downhole tools, according to one or more embodiments.

FIG. 3A shows a block diagram view of the power generation unit 270 operating to provide electrical power to the electric motor 284, in accordance with one or more embodiments. The direction of electrical power flow supplied to the electric motor 284 is indicated by the arrows A, B. The controller 282 includes an electric power controller 283 that includes an AC-DC converter 300 operable to convert the alternating current from the alternator into a DC voltage indicated as $V_{dc}$. The power controller 283 controls the power flow through the generator 280 with the control objective being the DC voltage level. The DC voltage level is affected by the current flow to or from both the generator 280 and the motor 284 and the power controller 283 and the motor controller 302 (discussed below). The power controller 283 thus is used to adjust the power flow through the generator 280 to keep the DC voltage at the desired level.

The controller 282 also includes a motor controller 302 with a DC-AC converter used to regulate the electrical power conducted to the electric motor 284. The motor controller 302 is a device similar to the power controller 283 except that the motor controller 302 controls the power flow through the motor 284. However, the control objective of the motor controller 302 is only the correct motion of the motor 284. Effects on the DC-link voltage are an indirect "side-effect." Thus, the power controller 283 and the motor controller 302 are two separate converters built the same, operated reverse to each other and connected at their respective DC terminals with a capacitor 294 being located in this DC connection. Alternatively, it is also possible to use controllers that are different from each other or incorporate both of these functionalities in a single physical device.

Figure 3B:
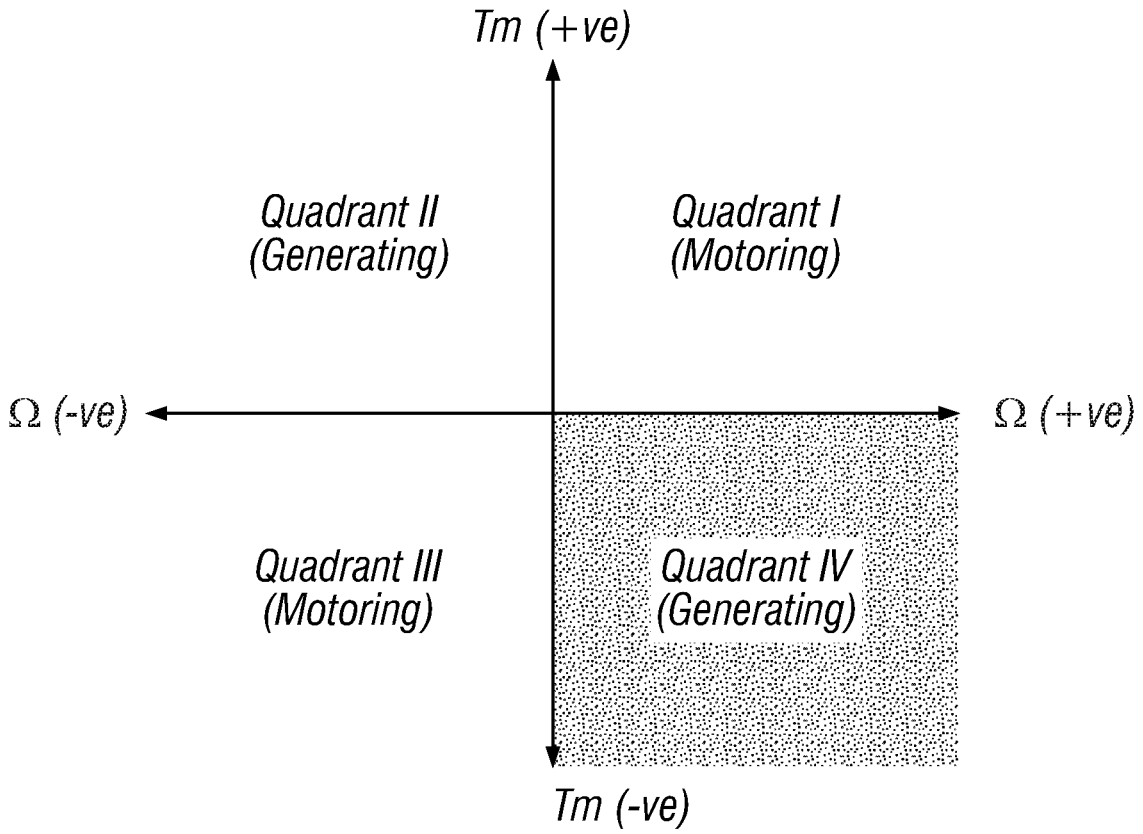
FIG. 3B shows a graph view of the operating modes for an electric generator and motor, respectively, of the power generation unit while operating as depicted in FIG. 3A, according to one or more embodiments.

FIG. 3B shows a graph view of the operating modes of a motor or generator. The y-axis of the graph shown in FIG. 3B indicates whether the torque of a motor or generator is positive or negative, and the x-axis of the graph indicates whether the rotational speed of the motor or generator is positive or negative. For examples, a motor or generator operating with positive torque and positive rotational speed would be operating as a motor to drive a mechanical load as indicated in Quadrant I. Likewise, a motor or generator operating with negative torque and negative rotational speed would be operating as a motor in Quadrant III. Quadrant II represents the operating mode where a motor or generator is operating with positive torque and negative rotational speed. Quadrant IV represents the operating mode where a motor or generator is operating with negative torque and positive rotational speed. Therefore, Quadrants I and III, where torque and speed have the same sign, indicate that a motor or generator is operating as a motor producing a positive power output that can drive a mechanical load. Quadrants II and IV, where torque and speed have opposite signs, indicate that a motor or generator is operating as a generator with the mechanical load driving the motor to produce an electrical power output in the reverse power flow direction.

Figure 4A:
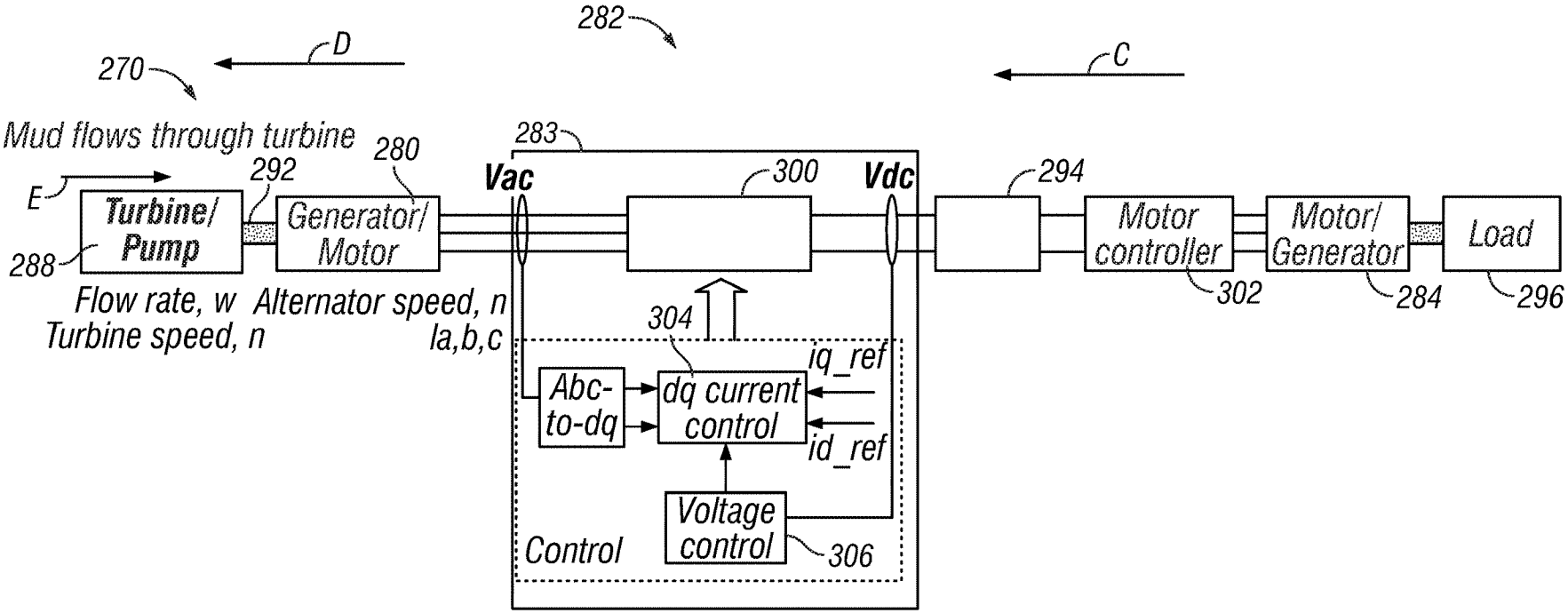
FIG. 4A shows a block diagram view of the power generation unit operating to dissipate excess electrical energy as hydraulic energy, according to one or more embodiments.
Figure 4B:
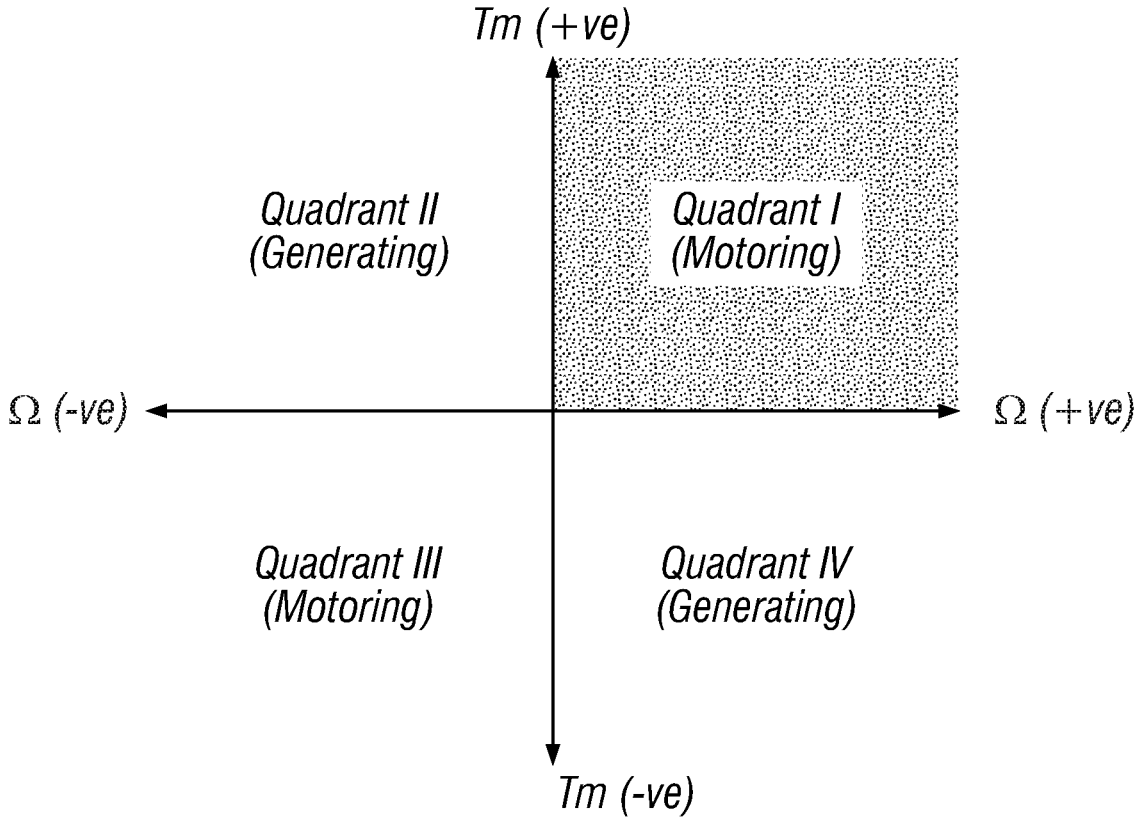
FIG. 4B shows a graph view of the operating modes for the electric generator and motor, respectively, of the power generation unit while operating as shown in FIG. 4A, according to one or more embodiments.

Quadrant IV is shaded to indicate the operating mode of the electric generator 280 of FIG. 3A. Quadrant I of FIG. 4B is shaded to indicate the operating mode of the motor 284 of FIG. 3A. The graphs demonstrate that the electric generator 280 and motor 284 are operating in their respective quadrants for the electric generator 280 to supply power to the motor 284 to produce a rotational drive force and control a downhole tool as previously described. While the generator 280 is producing electrical power to operate the motor 284, the generator 280 is operating in Quadrant IV, which is shaded in FIG. 3B, whereas the motor 284 is operating in Quadrant I, which is shaded in FIG. 4B. The condition of the turbine and generator acting as the source of electrical power and the motor load as the sink is the normal operation of the tool. In these circumstances the generator causes the turbine to create a pressure differential between the uphole and the downhole side of the turbine that is positive ($\Delta P = P_{uphole} - P_{downhole} > 0$).

In some cases that are different from normal operation the direction of power flow may be reversed. In this situation, the electric motor 284 operates in generating mode such that the electric motor 284 produces an electrical power output in the reverse power flow direction as indicated by arrows C, D of FIG. 4A and thus operates as a generator instead of a motor. The electric motor 284 may generate electrical power when the electric motor 284 shifts from producing a rotational drive force to running idle and subsequently producing a torque in the opposite direction thus decelerating to reduce the rotational speed output of the motor 284. As shown in FIGS. 4A and 3B, the electric motor 284 is operating in Quadrant IV and no longer in Quadrant I. The excess electrical energy generated by the motor in this situation must be dissipated in order to protect electrical components located downhole from overloading. To dissipate the excess electrical energy, the motor controller 302 converts the AC output of the electric motor 284 to a DC bias voltage. Excess electrical energy can be stored in the capacitor 294 and when the storage capacity of the capacitor 294 is exceeded, any additional excess energy is dissipated through the generator by means of the AC-DC converter 300 and the generator 280. The generator 280 now operates in Quadrant I and no longer in Quadrant IV, as shown in FIG. 4B, and conducts the excess electrical energy to the fluid-driven motor assembly 278 to dissipate the excess electrical energy to hydraulic energy and thus acts as a motor. As the generator operates in Quadrant I of FIG. 4B, the generator 280 applies torque to the drive shaft 292 and rotates the rotor of the fluid-driven motor assembly 278, preferably, such that the fluid-driven motor assembly 278 produces a negative pressure differential ($\Delta P = P_{uphole} - P_{downhole} < 0$) across the turbine 288 to allow fluid to flow in the direction indicated by arrow E such that the turbine 288 consumes power and acts as a pump. In this case the motor 284 with its load 296 temporarily acts as the source of electrical power and the generator 280 with the turbine 288 temporarily acts as the sink.

In order to drive the excess electrical energy back to the fluid-driven motor assembly 278, the active AC-DC converter 300 may be controlled by monitoring the quadrature currents $I_d$ and $I_q$ with an AC-DC controller 304 included with the power controller 283.

The Iq current is proportional to the torque or active power component of the generator 280, whereas the Id current is proportional to the reactive power component of the generator 280. The AC-DC converter 300 may include a multi-phase rectifier with rectifying switching devices (e.g., thyristors) controlled by pulsewidth modulation applied from the AC-DC controller 304, which monitors the electrical output of the generator 280 and determines when to activate the AC-DC converter 300. The AC-DC controller 304 may also monitor the DC voltage using a voltage controller 306 that is part of a DC output voltage regulator 301 to determine when to activate the AC-DC converter 300 or the amount of power to conduct to the fluid-driven motor assembly 278.

Management of the power flow may be performed by the power controller 282 and particularly through the voltage controller 306. The voltage controller 306 measures the DC link voltage, which is an indicator of how much energy is stored in the DC link capacitor, and when the DC link voltage rises above a certain level it directs the power flow back to the generator 280 and the turbine of the fluid-driven motor assembly 278. The power controller 282 and the motor controller 302 may thus be separate from each other without the need to communicate any measured values.

Figure 5:
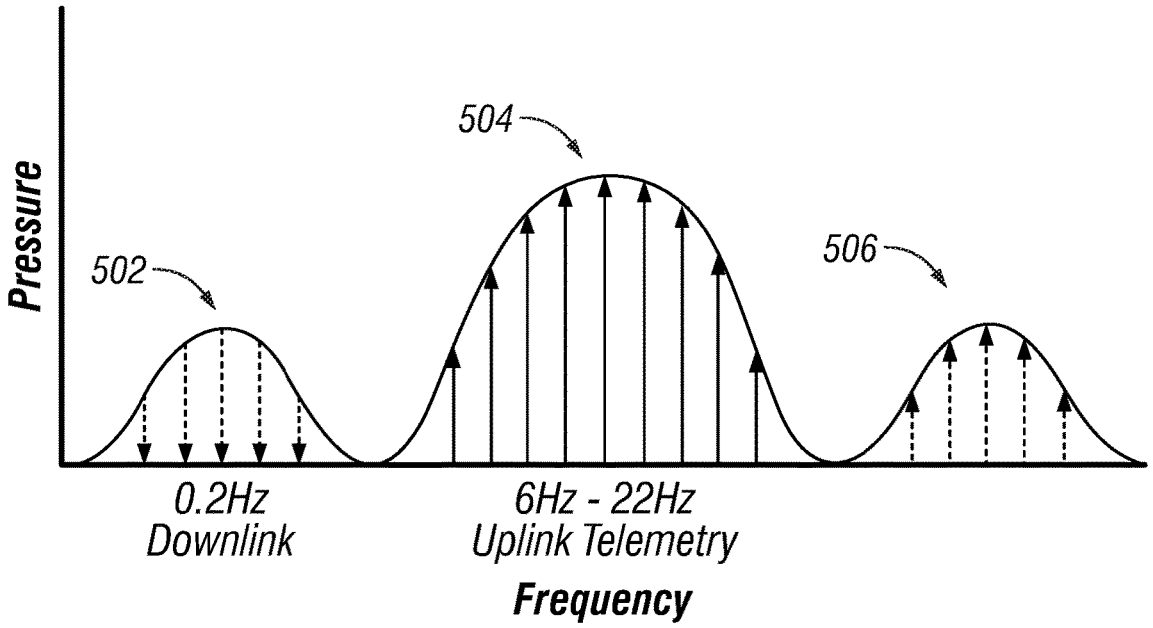
FIGS. 5-7 show graph views of the spectral response of a mud pulse telemetry system and the noise generated by the power generation unit while operating to dissipate excess electrical energy as hydraulic energy, according to one or more embodiments.
Figure 6:
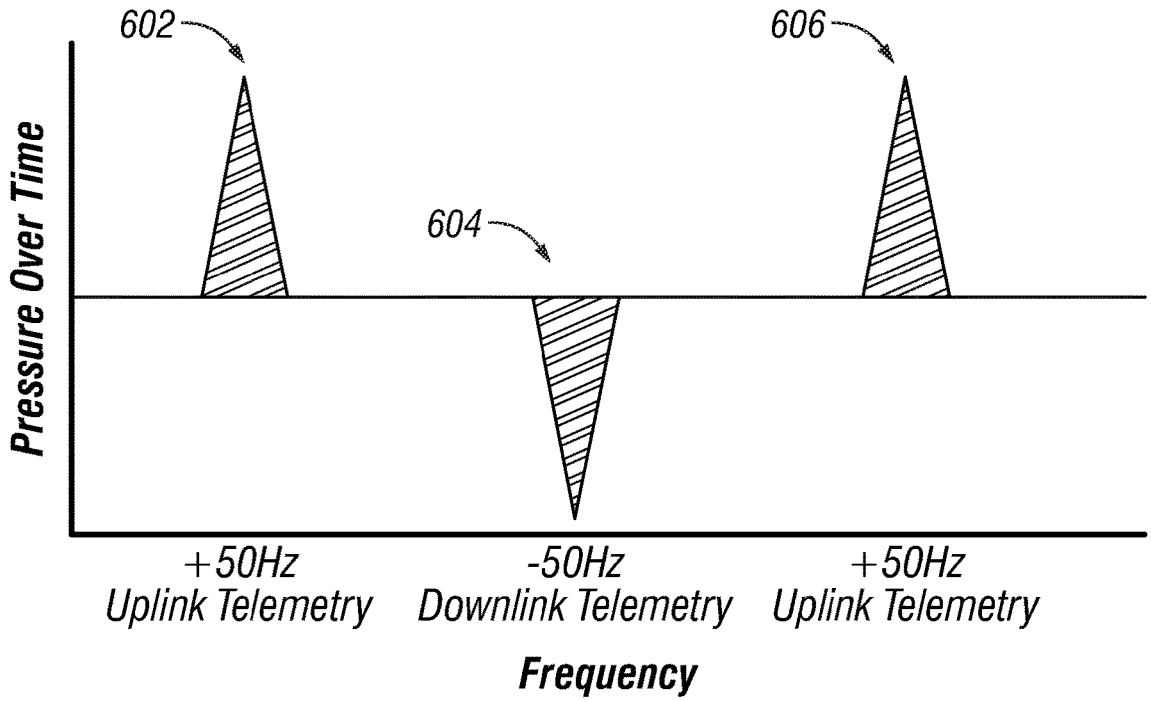

Alternatively, when the power controller 282 detects a reverse power flow as indicated by arrows C and D in FIG. 4A, the $I_q$ current output by the electric motor 284 changes in polarity, e.g., from a positive value to a negative value or vice-versa depending on the outputs of the electric motor 284 in Quadrants II and III as depicted in FIGS. 3B and 4B, which may indicate to the AC-DC controller 304 of FIG. 5 to enable the AC-DC converter 300 and rectify the electrical output of the motor 284 to a DC bias voltage.

As the DC bias voltage is applied to the electric generator 280, the excess electrical energy is transferred via the drive shaft 292 to the fluid-driven motor assembly 278, which in turn causes the fluid-driven motor assembly 278 to produce changes in pressure as the rotor rotates to create a pressure differential in the fluid bore of the drill string. The changes in fluid pressure in the drill string may interfere with communication bands used by a mud pulse telemetry system as previously discussed herein with respect to the drilling system 10 of FIG. 1. A mud pulse telemetry system occupies a frequency spectrum of band frequencies for downlink communications from the surface to downhole tools and uplink communications from the downhole tools to the surface. In order to reduce the interference caused by the fluid-driven motor assembly 278 as excess energy from the motor 284 is dissipated, the pressure noise produced by the fluid-driven motor assembly 278 may be controlled by the power controller 282 by controlling the voltage applied to the generator 280, and the noise may be regulated to stay below a noise threshold value, stay outside the communication frequency bands used by the mud pulse telemetry system, or combination thereof.

For example, FIG. 5 shows a graph view of the frequency spectrum of pressure pulses used by a mud pulse telemetry system, in accordance with one or more embodiments. Also shown in FIG. 5 is the pressure output of the mud pulse telemetry system as a function of frequency. Downlink communications may operate within the downlink band 502 at a fundamental frequency of 0.2 Hz and uplink communications may operate within an uplink band 504 of 6 to 22 Hz or 6 to 30 Hz. Therefore, the pressure noise from the energy dissipation as previously discussed may be regulated to produce pressure noise outside the communication bands 502 and 504 (e.g., at a frequency greater than 50 Hz in the noise band 506).

Figure 7:
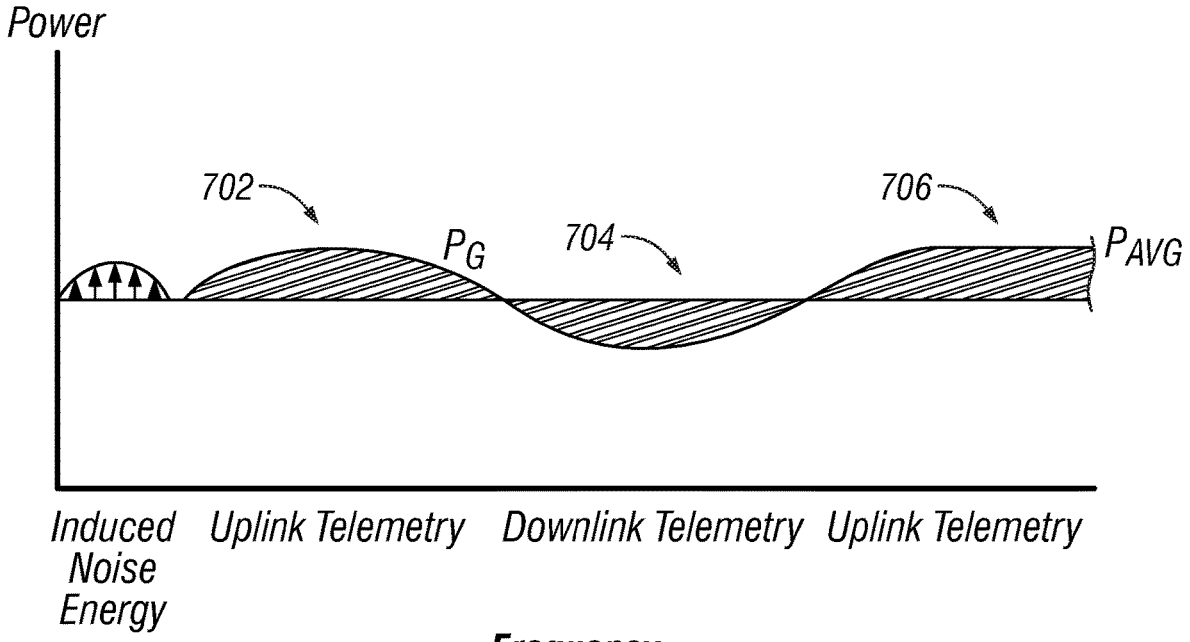

FIG. 7 also shows a graph view of the frequency spectrum of the pressure pulses generated by a telemetry system, in accordance with one or more embodiments. As shown, the power generation unit 278 may be configured to produce noise outside the communication bands 502, 504, and 506 shown in FIG. 5 while dissipating excess electrical energy to the fluid-driven motor assembly 278.

The power generation unit 270 may also reduce the telemetry interference produced by the energy dissipation by operating the fluid-driven motor assembly 278 with less energy than the signal to noise ratio of the mud pulse telemetry system. FIG. 7 shows a graph view of the spectral power levels of the telemetry system for the uplink bands 702, 706 and the downlink band 704. The fluid-driven motor assembly 287 can be operated to produce noise energy at power levels less than the power levels the communication bands 702, 704, and 706 to reduce the interference with the mud pulse telemetry system. The fluid driven motor assembly 287 can also be operated to produce noise energy at amplitudes that would attenuate enough by the time they reach the surface that the signal would not be interfered with sufficiently to affect pulse detection. Attenuation would be strongest on the higher end of the frequency spectrum.

This disclosure describes a power generation unit that dissipates excess electrical energy as hydraulic energy to convert the excess energy into lower circulating pressure. The power generation unit of the present disclosure significantly improves the reliability and run time of downhole tools by removing the need for electrically resistive elements to dissipate excess energy as the resistive elements are expensive, limit the amount of energy that can be dissipated, take up additional space, and introduce components prone to failure during downhole operations and introduce unwanted heat into the controller.

In addition to the embodiments described above, many examples of specific combinations are within the scope of the disclosure, some of which are detailed below:

Example 1. A system for use with a downhole tool, comprising:

- a tubular comprising a fluid flow path therethrough for flowing a fluid;
- a housing coupleable to a downhole portion of the tubular and comprising a fluid inlet to receive at least a portion of the fluid flowing through the tubular;
- a fluid-driven motor assembly with a drive shaft rotatable to output rotational drive forces;
- an electric generator operatively coupled to the drive shaft and operable to convert the rotational drive forces into electrical power;
- an electric motor electrically coupled to the electric generator and operable to convert electrical output of the electric generator into a rotational drive force to control the downhole tool; and
- a controller electrically coupled to the electric motor and the electric generator and operable to conduct electrical power output from the electric motor to the electric generator and dissipate excess energy produced by the electric motor to the fluid-driven motor assembly as hydraulic energy.

Example 2. The system of Example 1, further comprising a capacitor electrically coupled to the electric motor and electric generator to store electrical energy communicated between the electric motor and the electric generator.

Example 3. The system of Example 1, wherein the fluid-driven motor assembly comprises a turbine positioned in the flow of the fluid to rotate the drive shaft.

Example 4. The system of Example 1, wherein the controller is further operable to adjust the electrical power output from the electric motor conducted to the electric generator to reduce pressure interference with a telemetry system.

Example 5. The system of Example 1, wherein the controller is further operable to control the electrical power output from the electric motor conducted to the electric generator to produce pressure noise outside of a telemetry communication frequency spectrum.

Example 6. The system of Example 1, wherein the controller is further operable to control the electrical power output from the electric motor conducted to the electric generator to produce pressure noise below a threshold relative to pressure output of a telemetry system.

Example The system of Example 1, further comprising an AC-DC converter electrically coupled between the electric motor and the electric generator and operable to conduct a DC bias voltage to the electric generator.

Example The system of Example 7, wherein the controller is electrically coupled to the AC-DC converter and operable to control the AC-DC converter by monitoring output currents from the electric motor, the level of the DC bias voltage, or any combination of the two.

Example 9. The system of Example 1, wherein the electric generator comprises a multi-phase alternator.

Example 10. The system of Example 1, further comprising a bottomhole assembly comprising a rotary steerable system operated by the electric motor.

Example 11. A method of dissipating excess energy produced downhole in a tubular with fluid flowing therethrough, comprising:

rotating a drive shaft of a fluid-driven motor assembly by delivering the fluid across a turbine;

generating electrical power with an electric generator coupled to the drive shaft; and conducting electrical power output, with a controller, from an electric motor to the electric generator and dissipating excess energy produced by the electric motor to the fluid-driven motor assembly as hydraulic energy.

Example 12. The method of Example 11, further comprising actuating a downhole tool with the electric motor by converting electrical output of the electric generator into a rotational drive force.

Example 13. The method of Example 11, further comprising storing electrical energy communicated between the motor and the generator in a capacitor electrically coupled to the motor and the generator.

Example 14. The method of claim 11, further comprising adjusting the electrical power output, with the controller, conducted to the electric generator from the electric motor to reduce pressure interference with a telemetry system.

Example 15. The method of Example 11, further comprising controlling the electrical power output, with the controller, conducted to the electric generator from the electric motor to produce pressure noise outside of a telemetry communication spectrum.

Example 16. The method of claim 11, further comprising controlling the electrical power output, with the controller, conducted to the electric generator from the electric motor to produce pressure noise below a threshold relative to pressure output of a telemetry system.

Example 17. The method of Example 11, further comprising operating a rotary steerable system with the electric motor.

Example 18. A tool for dissipating excess energy generated by a motor, comprising:

a drive shaft configured to output rotational drive forces;

an electric generator operatively coupled to the drive shaft and configured to convert the rotational drive forces into electrical power;

an electric motor electrically coupled to the electric generator and configured to convert electrical output of the electric generator into a rotational drive force; and a controller operable to conduct electrical power output from the electric motor to the electric generator and dissipate excess energy produced by the electric motor to the drive shaft as hydraulic energy.

Example 19. The tool of Example 18, wherein the controller is further operable to adjust the electrical power output from the electric motor conducted to the electric generator to reduce pressure interference with a telemetry system.

Example 20. The tool of Example 18, further comprising a bottomhole assembly comprising a rotary steerable system operated by the electric motor.

This discussion is directed to various embodiments of the present disclosure. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present invention has been described with respect to specific details, it is not intended that such details should be regarded as limitations on the scope of the invention, except to the extent that they are included in the accompanying claims.

What is claimed is:

1. A system for use with a downhole tool, comprising:

a tubular comprising a fluid flow path therethrough for flowing a fluid;

a housing coupleable to a downhole portion of the tubular and comprising a fluid inlet to receive at least a portion of the fluid flowing through the tubular;

a fluid-driven motor assembly with a drive shaft rotatable to output rotational drive forces;

an electric generator operatively coupled to the drive shaft and operable to convert the rotational drive forces into electrical power;

an electric motor electrically coupled to the electric generator and operable to convert electrical output of the electric generator into a rotational drive force to control the downhole tool;

an AC-DC converter electrically coupled between the electric generator and the electric motor;

a motor controller electrically coupled to the electric motor and the electric generator and operable to convert electrical power output from the electric motor to a DC bias voltage;

a mud pulse telemetry system operatively coupled to the fluid flow path of the tubular; and a power controller operable to conduct the DC bias voltage to the electric generator to dissipate excess energy produced by the electric motor to the fluid-driven motor assembly as hydraulic energy, wherein the power controller is further operable to adjust the electrical power output from the electric motor conducted to the electric generator to reduce pressure interference with the mud pulse telemetry system.

2. The system of claim 1, further comprising a capacitor electrically coupled to the electric motor and electric generator to store electrical energy communicated between the electric motor and the electric generator.

3. The system of claim 1, wherein the fluid-driven motor assembly comprises a turbine positioned in the flow of the fluid to rotate the drive shaft.

4. The system of claim 1, wherein the power controller is further operable to control the electrical power output from the electric motor conducted to the electric generator to produce pressure noise outside of a telemetry communication frequency spectrum.

5. The system of claim 1, wherein the power controller is further operable to control the electrical power output from the electric motor conducted to the electric generator to produce pressure noise below a threshold relative to pressure output of the mud pulse telemetry system.

6. The system of claim 1, wherein the power controller is electrically coupled to the AC-DC converter and operable to control the AC-DC converter by monitoring output currents from the electric motor, the level of the DC bias voltage, or any combination of the two.

7. The system of claim 1, wherein the electric generator comprises a multi-phase alternator.

8. The system of claim 1, further comprising a bottomhole assembly comprising a rotary steerable system operated by the electric motor.

9. A method of dissipating excess energy produced downhole in a tubular with fluid flowing therethrough, comprising:

rotating a drive shaft of a fluid-driven motor assembly by delivering the fluid across a turbine;

operating an electric generator coupled to the drive shaft;

operating an electric motor using a motor controller;

converting electrical power output, with the motor controller, from an electric motor to a DC bias voltage;

conducting the DC bias voltage, with a power controller, to the electric generator and dissipating excess energy produced by the electric motor to the fluid-driven motor assembly as hydraulic energy; and adjusting the electrical power output, with the power controller, conducted to the electric generator from the electric motor to reduce pressure interference with a mud pulse telemetry system.

10. The method of claim 9, further comprising actuating a downhole tool with the electric motor by converting electrical output of the electric generator into a rotational drive force.

11. The method of claim 9, further comprising storing electrical energy communicated between the electric motor and the electric generator in a capacitor electrically coupled to the electric motor and the electric generator.

12. The method of claim 9, further comprising controlling the electrical power output, with the power controller, conducted to the electric generator from the electric motor to produce pressure noise at least one of outside of a telemetry communication spectrum or below a threshold relative to pressure output of the mud pulse telemetry system.

13. The method of claim 9, further comprising operating a rotary steerable system with the electric motor.

* * * * *